US008127583B2

(12) United States Patent
Kipping et al.

(10) Patent No.: US 8,127,583 B2
(45) Date of Patent: Mar. 6, 2012

(54) COILER MANDREL

(75) Inventors: Matthias Kipping, Herdorf (DE); Ali Bona, Kreuztal (DE); Thomas Holzhauer, Kirchhundem (DE); Juergen Merz, Kreuztal (DE); Michael Braukmann, Hilchenbach (DE)

(73) Assignee: SMS Demag AG, Duesseldorf (DE)

( * ) Notice: Subject to any disclaimer, the term of this patent is extended or adjusted under 35 U.S.C. 154(b) by 499 days.

(21) Appl. No.: 12/305,961

(22) PCT Filed: Jun. 12, 2007

(86) PCT No.: PCT/EP2007/005156

§ 371 (c)(1),
(2), (4) Date: Mar. 16, 2009

(87) PCT Pub. No.: WO2007/147502

PCT Pub. Date: Dec. 27, 2007

(65) Prior Publication Data

US 2010/0236312 A1 Sep. 23, 2010

(30) Foreign Application Priority Data

Jun. 22, 2006 (DE) ..... 10 2006 029 103
Oct. 10, 2006 (DE) ..... 10 2006 048 087

(51) Int. Cl.
*B21C 47/00* (2006.01)

(52) U.S. Cl. ..... 72/146; 242/574.4; 242/575.5

(58) Field of Classification Search ..... 72/146, 72/148, 393; 242/571, 574, 574.4, 575, 575.5
See application file for complete search history.

(56) References Cited

U.S. PATENT DOCUMENTS

| | | | |
|---|---|---|---|
| 3,814,275 A | 6/1974 | Lemons | |
| 5,123,606 A | 6/1992 | Braun | 242/72.1 |

FOREIGN PATENT DOCUMENTS

| | | |
|---|---|---|
| DE | 10347262 | 10/2004 |
| FR | 2019099 | 6/1970 |
| JP | 50142736 A | 11/1974 |
| JP | 3092413 A | 4/1991 |
| UA | 6860 C1 | 5/2005 |

*Primary Examiner* — Mark Rosenbaum
(74) *Attorney, Agent, or Firm* — Andrew Wilford

(57) ABSTRACT

A mandrel for winding sheet metal has a generally tubular mandrel body extending along and centered on an axis and formed at one end with a plurality of radially throughgoing and angularly spaced apertures each having a pair of closed and axially confronting end faces, a spreading bar extending axially inside the body and having a respective pivot adjacent each of the apertures, respective rigid links extending through the apertures and having inner ends carried on the respective pivots and outer ends projecting outside the body, and respective segments outside the body and each pivoted on the outer end of a respective one of the links. Respective pressure plates are operatively connected at the one end between the segments and the mandrel body.

12 Claims, 4 Drawing Sheets

Fig. 6
Prior Art
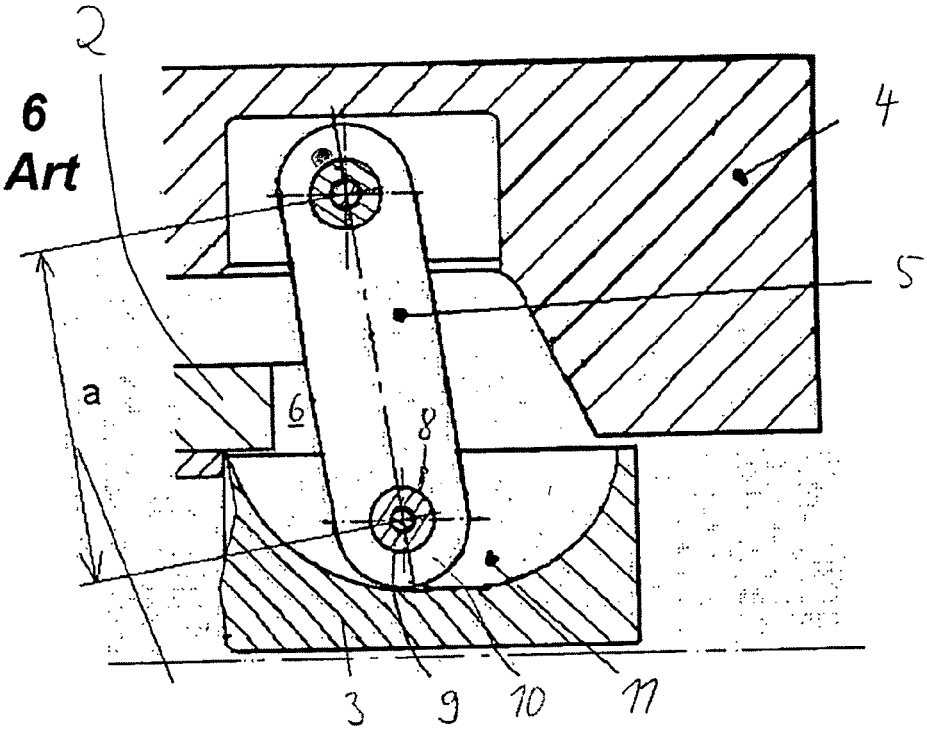
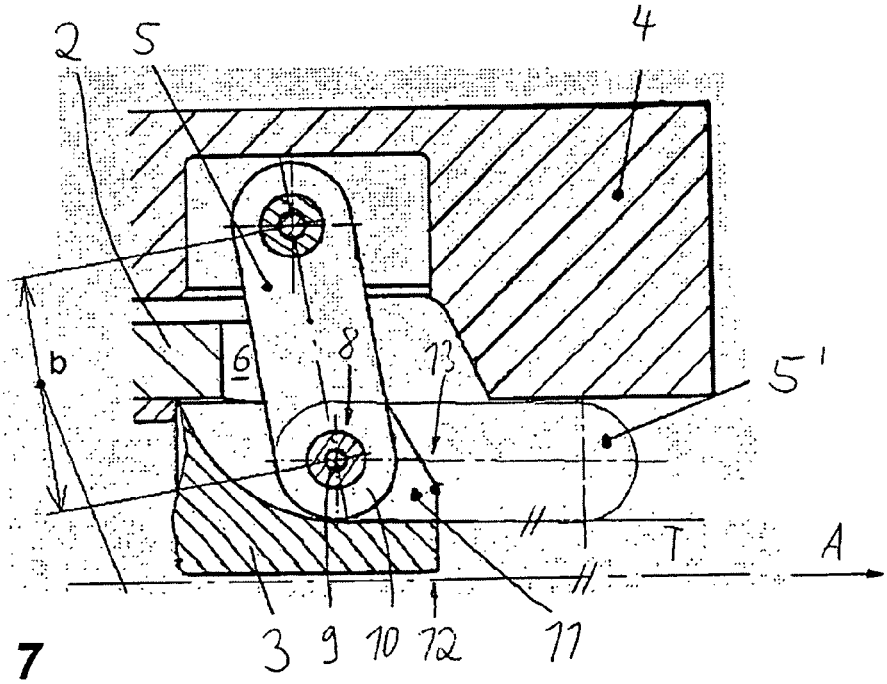
Fig. 7

COILER MANDREL

CROSS REFERENCE TO RELATED APPLICATIONS

This application is the US national stage of PCT application PCT/EP2007/005156, filed 12 Jun. 2007, published 27 Dec. 2007 as WO2007/147502, and claiming the priority of German patent application 2006029103.4 itself filed 22 Jun. 2006 and German patent application PCT/EP2007/005156 itself filed 12 Jun. 2007, whose entire disclosures are herewith incorporated by reference.

FIELD OF THE INVENTION

The invention relates to a reel mandrel for winding high-strength and super high-strength materials.

BACKGROUND OF THE INVENTION

Known from document EP 0 413 985 [U.S. Pat. No. 5,123,606] is a reel mandrel for straight-edged winding of or unwinding of metal strip to form a coil or from a coil, in particular for winding rolled hot strip, comprising a driven reel mandrel which is supported so as to be rotatable, substantially consisting of a mandrel body, segments and spreading bar, wherein the segments can be spread in the radial direction with the intermediary of the spreading bar which is movable axially in the mandrel body and a coupling of a drive rotating with the reel mandrel, which is movable with the spreading bar. In this case, the coupling is arranged with a play corresponding to the spreading of the reel mandrel between an emergency de-spreading device and the housing of the hydraulic drive, wherein the emergency de-spreading device and the housing of the hydraulic drive are immovable with respect to the mandrel body in the axial direction and wherein the movement of the coupling in the sense of a reduction in the diameter of the reel mandrel is limited by the emergency de-spreading device and the emergency de-spreading device makes it possible to additionally release the axial mobility of the spreading bar connected to the coupling by a certain amount of distance. Such a reel mandrel satisfactorily fulfils its allotted task of winding hot strip.

DE 103 47 262 B3 discloses a grease distribution system for a reel mandrel whereby the grease distributors are arranged in a grease distribution ring which is flange-mounted to the mandrel shaft at its end face and which is provided with channels which are connected to axial bores arranged in the mandrel shaft, the bores leading directly and/or via cross-bores to the lubrication points. The reel to be designated as a standard reel mandrel in this document further consists of a mandrel body, a spreading bar with links for holding the segments. A shaft is screwed onto the end face of the mandrel body to which a roller bearing with housing is attached. This unit is then supported by a pivotal holder. The pivotal holder (hereinafter called mandrel mounting) grips around the roller bearing with its housing from two sides and supports this during the winding process. During removal of the coil the mandrel mounting pivots away from the roller bearing and its housing and thus exposes the path for removal of the coil.

The mandrel body is configured as open at the front so that the spreading bar with the links and the pressure plates to the segments can be mounted inside the mandrel body.

This design allows the spreading bar, the links and the pressure plates to be mounted easily. The rigidity of this design is sufficient for the usual loading.

As a result of the increasing tendency to roll and wind increasingly higher-strength steels, the requirement for the reel mandrel of a hot-strip train will increase substantially. The loading can easily be between twice and three times the loading compared with a standard reel mandrel.

An example of these high-strength steels are the tube quality stages according to the American API standard grade B and the quality stages X42 to X80. At present, the tube quality stages X100 to X120 are being developed and beginning to be used. These materials constitute a completely new development. They should satisfy the requirement for higher strength, improved corrosion resistance and an increase in the collapse resistance (for marine use).

OBJECT OF THE INVENTION

The object of the present invention is thus to increase the stiffness of a reel mandrel of the genre specified initially and to thus provide a reel mandrel for winding high-strength and super high-strength steels.

SUMMARY OF THE INVENTION

This object is achieved whereby when mounted, at least a number of links of the reel mandrel pass through recesses in the mandrel body which are inserted in the mandrel body such that this is at least free from recesses at its axial end.

Preferably all the links pass through recesses in the mandrel body which are inserted in the mandrel body such that this is free from recesses at its axial ends.

As a result of the configuration of the mandrel body provided according to the invention, which is closed at the end face and free from recesses, a substantially more rigid reel structure is obtained, as will be seen in detail.

At least some of the recesses can be configured as rectangular openings in the mandrel body when viewed from above.

The mandrel body mostly has a substantially cylindrical outer contour. At least one axial end of the mandrel body, preferably both axial ends of the mandrel body, is preferably free from recesses over an axial extension. It has proved effective if it is provided that this axial extension is at least 10%, preferably at least 15% of the outside diameter of the mandrel body.

Preferably four recesses for passage of links are distributed uniformly over the circumference of the mandrel body.

The advantageous inventive concept can be used particularly effectively if special measures are taken for mounting the mandrel body. Accordingly, it is advantageously provided that at least one link is pivotally mounted at a hinge point in the spreading bar, wherein the axis of the hinge point is arranged transversely to the axial direction of the spreading bar and wherein the end of the link is arranged in a recess incorporated in the outer circumference of the spreading bar. The recess is preferably arranged in an axial end of the spreading bar. Furthermore, a particularly simple possibility for mounting is obtained if it is further provided that the recess is configured in radial section such that the tangent at its one axial end points in the axial direction of the spreading bar.

According to the invention, by suitable design modifications to the spreading bar, the links, the mandrel body and by changing the mounting sequence, the mandrel body is thus configured as closed at the front end to allow a higher loading capacity.

This yields the following advantages:

The mandrel body is overall stiffer (no more open profile).

The linking of the mandrel extension is better because larger pitch circle diameters for the draw-in bolts and more draw-in bolts are possible.

An improvement in the centering of the mandrel extension can be achieved, i.e.:

a) The centering area is closed.

b) The centering has become larger in diameter.

c) As a result of the above points the area has become larger and the structure has become more rigid. The loading has thus been reduced.

The end faces of the mandrel body and the mandrel extension are configured as more rigid (mandrel about 80% and mandrel extension about 5% improvement). The efficiency of the draw-in bolts has thus been improved.

The wear plates of the mandrel segments are now supported on the closed mandrel body and no longer via the mandrel extension. The load on the draw-in bolts is thus reduced.

Overall, a substantially more stable reel arrangement is obtained, which is suitable for reeling strong and high-strength strip.

BRIEF DESCRIPTION OF THE DRAWING

The drawings show illustrated embodiments according to the prior art and according to the invention.

In the figures:

FIG. 6 shows the axial end section of the mandrel body, the spreading bar and a segment of a reel mandrel in radial section according to the prior art, and FIG. 7 is a view like FIG. 6 of a reel mandrel according to the invention.

DETAILED DESCRIPTION

Figure 1:
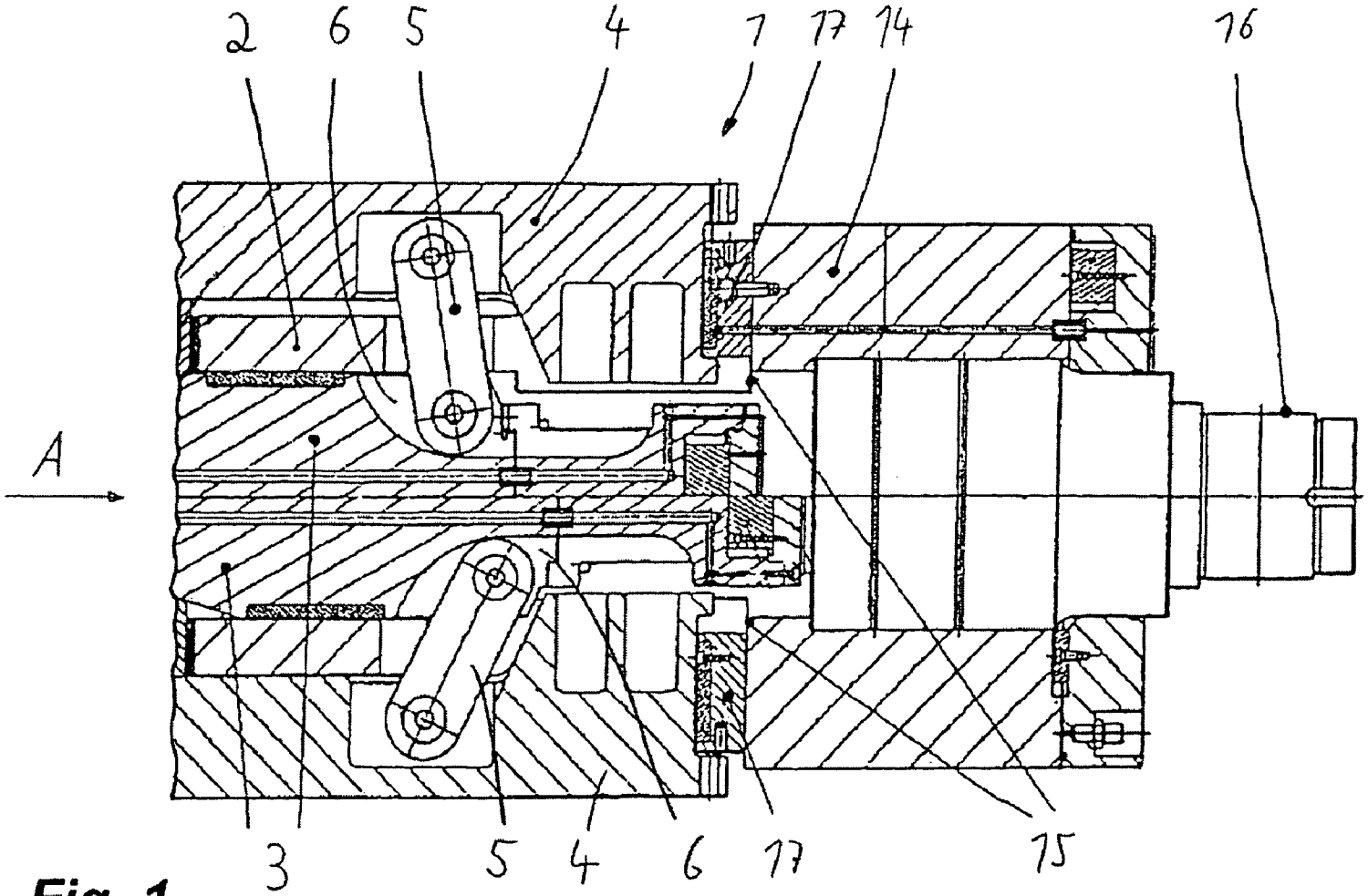
Fig. 1 Prior Art
FIG. 1 is a radial section through a part of a reel mandrel according to the prior art.
Figure 3:
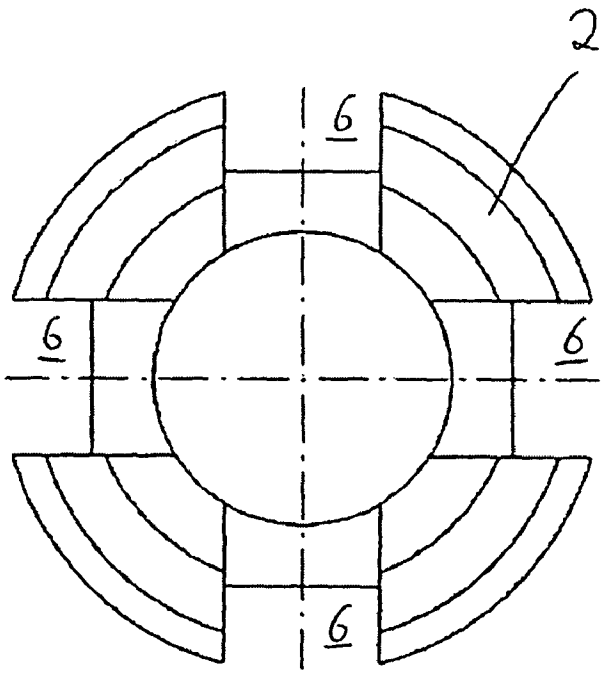
Fig. 3 Prior Art
FIG. 3 shows the view B of the reel mandrel according to FIG. 2.
Figure 2:
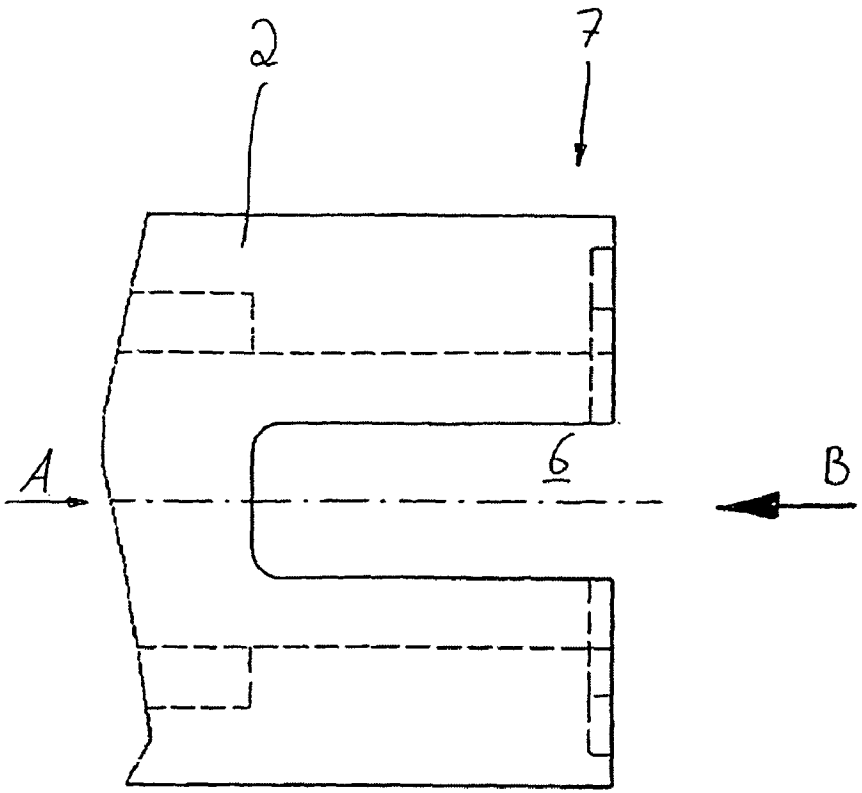
Fig. 2 Prior Art
FIG. 2 shows one axial end of the mandrel body of the reel mandrel according to FIG. 1.

FIGS. 1 to 3 illustrate a previously known solution. The reel mandrel 1 shown comprises a mandrel body 2 configured as substantially cylindrical, in which a spreading bar 3 is arranged so that it can be displaced in the axial direction A relative to the mandrel body 2. A plurality of segments 4 are arranged displaceably i.e. so that they can be spread, around the mandrel body 2. During the axial displacement of the spreading bar 3 relative to the mandrel body 2, wedge-shaped run-in surfaces on the spreading bar, which are not shown, ensure that the segments 4 are pressed radially outward. For details reference is made to EP 0 413 985 B1 in which this known embodiment is described in detail. The radial withdrawal of the segments during the axial movement of the spreading bar 3 in the opposite direction is ensured by links 5 which are arranged on the spreading rod 3 and on the segments 4 in a hinged manner. This is also illustrated and described in further detail in the EP 0 413 985 B1.

A shaft 14 is screwed onto the front end of the mandrel body 2, a roller bearing with housing being mounted thereon. In FIG. 1 the bolting surface 15 of the shaft 14 (also designated as a mandrel extension) is shown on the mandrel body 2. The receptacle for the roller bearing is designated by 16. The front end of the shaft 14 contacts the segments 14 via pressure plates 17.

The entire unit is then supported by a pivotal holder. The pivotal holder (also called mandrel mounting) grips from two sides around the roller bearing with its housing (not shown) and supports this during the winding process. During removal of the wound coil the mandrel mounting pivots away from the roller bearing and its housing and thus exposes the path for removal of the coil.

As can be seen in FIGS. 2 and 3, the mandrel body 2 is configured as open at the front, i.e. at the front end, so that the spreading bar 3 with the links 5 secured thereon can be mounted in the mandrel body 2. Simple mounting is thus ensured by the recesses 6 which are incorporated in the axial end 7 of the mandrel body 2.

A relatively severe weakening of the axial end of the mandrel body 2 is thus disadvantageously obtained so that the reel mandrel is limited in its rigidity. The reeling of high-strength strip material is thus only possible to a limited extent with such a reel mandrel.

Figure 5:
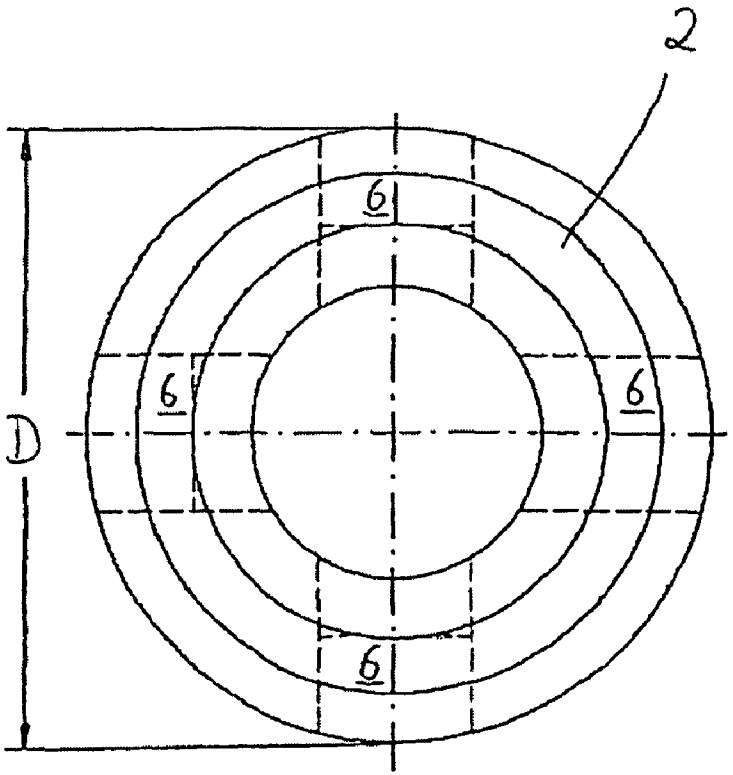
FIG. 5 shows the view C of the reel mandrel according to FIG. 4.
Figure 4:
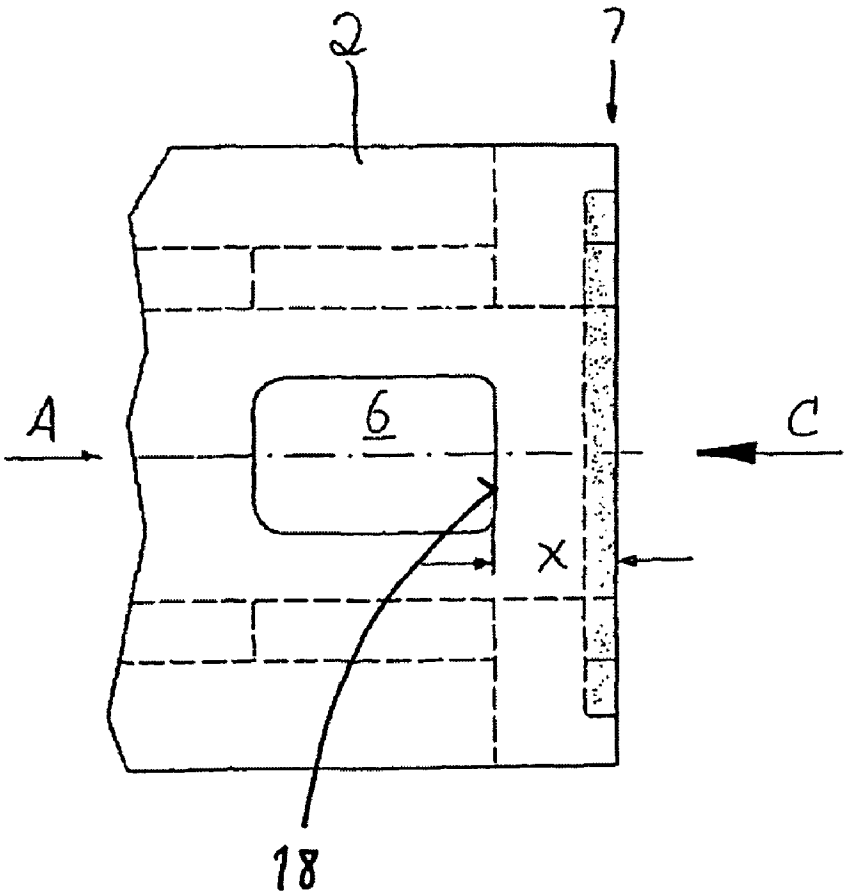
FIG. 4 is a view like FIG. 2 of the mandrel body according to the invention.

To avoid this disadvantage, the invention provides the solution sketched in FIGS. 4 and 5. In this case, the axial end 7 of the mandrel body 2 is free from recesses 6. Rather, these are only provided after a first axial extension x—measured in the axial direction—and are provided as openings in the hollow-cylindrical wall of the mandrel body 2. In this case, the axial extension x is located at least 10% of the outside diameter D of the mandrel body 2. At the same time, the recesses 6 as shown in FIG. 4 have a substantially rectangular contour.

The following configuration is provided to ensure simple mounting of the reel mandrel:

In the prior art (see FIG. 6), the individual links 5 are positioned with one end 10 at a hinge point 8 with the axis 9 of the hinged joint in a recess 11. The recess 11 has a trough-shaped contour in radial section. The links 5 project upward during assembly so that the spreading bar 3 with links 5 secured thereto can be inserted into the mandrel body 2. This is made possible by the open configuration of the mandrel body 2 at the front end.

However, in the solution according to the invention such mounting is not possible since the mandrel body 2 is closed at the front end. Thus, as can be seen in FIG. 7, the recess 11 for the hinge point 8 of the link 5 is designed so that it is arranged in an axial end 12 of the spreading bar 3. It is further provided that the recess 11 is configured in radial section such that the tangent T at its one axial end 13 points in the axial direction A of the spreading bar 3. It thus becomes possible to position the links 5 arranged on the spreading bar 3 during assembly as indicated by the reference numeral 5'. In this position the spreading bar 3 together with the links 5 can be inserted into the mandrel body 2.

The operating mode of the links 5 is determined by the distances a (see FIG. 6) or b (see FIG. 7). The distance b is designed by the person skilled in the art such that there are no problems of collisions with other components during assembly and after insertion of the spreading bar 3 into the mandrel body 2, the links 5 can be folded from the position 5' into the position designated by 5. The adjacent components (in particular, the shape and size of the recesses 6) are optionally designed accordingly.

The advantage of the proposed arrangement is that the spreading bar 3 together with links 5 secured thereon can now be mounted easily.

The proposed reel mandrel 1 is exceptionally suitable for winding high-strength and super high-strength materials.

The invention claimed is:

1. A mandrel for winding sheet metal, the mandrel comprising:

a generally tubular mandrel body extending along and centered on an axis and formed at one end with a plurality of radially throughgoing and angularly spaced apertures each having a pair of closed and axially confronting end faces;

a spreading bar extending axially inside the body and having a respective pivot adjacent each of the apertures;

respective rigid links extending through the apertures and having inner ends carried on the respective pivots and outer ends projecting outside the body;

respective segments outside the body and each pivoted on the outer end of a respective one of the links;

respective pressure plates operatively connected at the one end between the segments and the mandrel body; and means for shifting the bar axially and thereby moving the links between one end position forming a predetermined acute angle with the axis and with the segments in inner positions relatively closely radially spaced to the axis and an opposite end position extending at a more perpendicular angle to the axis with the links bearing axially on one of the end faces of the respective aperture and the segments spaced outward of the respective inner positions.

2. The mandrel defined in claim 1 wherein the apertures are generally rectangular seen radially.

3. The mandrel defined in claim 1 wherein the body has a substantially cylindrical outer surface.

4. The mandrel defined in claim 1 wherein the mandrel body has at the one end an axially directed end face and an annularly continuous end region between same and the apertures, the pressure plates engaging the end region.

5. The mandrel defined in claim 4 wherein the end region has an axial length equal to at least 10% of an overall axial length of the mandrel body.

6. The mandrel defined in claim 1 wherein the apertures are angularly equispaced about the axis.

7. The mandrel defined in claim 1 wherein the inner ends are each pivoted on the bar at an inner pivot axis and the bar is formed at each of the inner ends with a radially outwardly open recess in which the respective inner pivot axis is recessed and in which the inner end of the respective link engages.

8. The mandrel defined in claim 7 wherein each recess is axially open, whereby, when the link outer ends are not attached to the respective segments, the links can be pivoted to extend substantially axially past the bar.

9. The mandrel defined in claim 7 wherein each recess is shaped such in radial section that a tangent to its one axial end face is directed axially.

10. The mandrel defined in claim 7, further comprising a shaft juxtaposed with the one end and fixed to the mandrel, the pressure plates being carried on the shaft.

11. The mandrel defined in claim 1 wherein the inner ends are pivoted at respective inner axes on the bar and all the inner axes lie in a common plane perpendicular to the bar axis.

12. The mandrel defined in claim 1 wherein each aperture is of a length such that, when the links are not attached to the respective segments, the links can pivot about their inner ends through the respective apertures.

* * * * *